US008400385B2

(12) United States Patent
Peng et al.

(10) Patent No.: US 8,400,385 B2
(45) Date of Patent: Mar. 19, 2013

(54) METHOD FOR ENHANCING AN IMAGE DISPLAYED ON AN LCD DEVICE

(75) Inventors: Huajun Peng, Tai Po (HK); Wei Zhang, Clear Water Bay (HK); Chun Kit Hung, Kowloon (HK)

(73) Assignee: Hong Kong Applied Science and Technology Research Institute Company Limited, Shatin, New Territories (HK)

( * ) Notice: Subject to any disclaimer, the term of this patent is extended or adjusted under 35 U.S.C. 154(b) by 841 days.

(21) Appl. No.: 11/962,320

(22) Filed: Dec. 21, 2007

(65) Prior Publication Data

US 2009/0160877 A1 Jun. 25, 2009

(51) Int. Cl.
*G09G 5/10* (2006.01)

(52) U.S. Cl. ..... 345/89; 345/63; 345/77; 345/690

(58) Field of Classification Search ..... 345/38, 345/50, 60, 64, 87–90, 97, 102, 104, 690; 349/173

See application file for complete search history.

(56) References Cited

U.S. PATENT DOCUMENTS

| | | | | |
|---|---|---|---|---|
| 7,027,016 | B2 | 4/2006 | Sakashita | |
| 7,199,776 | B2 | 4/2007 | Ikeda et al. | |
| 7,309,851 | B2 | 12/2007 | Huang et al. | |
| 2002/0126079 | A1 | 9/2002 | Willis et al. | |
| 2004/0104886 | A1 * | 6/2004 | Kawano | 345/102 |
| 2004/0257324 | A1 * | 12/2004 | Hsu | 345/89 |
| 2005/0184952 | A1 * | 8/2005 | Konno et al. | 345/102 |
| 2006/0268180 | A1 | 11/2006 | Chou | |
| 2007/0041636 | A1 | 2/2007 | Yoon et al. | |
| 2007/0092139 | A1 | 4/2007 | Daly | |
| 2007/0120806 | A1 * | 5/2007 | Schmidt et al. | 345/102 |
| 2007/0236517 | A1 * | 10/2007 | Kimpe | 345/690 |
| 2008/0117446 | A1 * | 5/2008 | Fukasawa | 358/1.9 |

FOREIGN PATENT DOCUMENTS

| | | | |
|---|---|---|---|
| CN | 101042841 | A | 9/2007 |
| JP | 1995129113 | A * | 5/1995 |
| JP | 2000330542 | A * | 11/2000 |

* cited by examiner

*Primary Examiner* — Amare Mengistu
*Assistant Examiner* — Vinh Lam
(74) *Attorney, Agent, or Firm* — Leydig, Voit & Mayer, Ltd.

(57) ABSTRACT

A method and apparatus for image enhancement in a display illuminated by a lighting device. Enhancement is via use of a non-linear mapping function. An illumination level for the lighting device is determined and used with the mapping function to find a compensation factor for each pixel of the image. The brightness property of each pixel is adjusted by its compensation factor.

10 Claims, 3 Drawing Sheets

METHOD FOR ENHANCING AN IMAGE DISPLAYED ON AN LCD DEVICE

BACKGROUND TO THE INVENTION

1. Field of the Invention

The current invention relates to liquid crystal display (LCD) devices that use a light source for viewing of an image. More particularly, the invention relates to a method and apparatus for enhancing an image displayed on a LCD panel illuminated by a lighting device.

2. Background Information

Various liquid crystal display (LCD) devices use a lighting source to either project an image onto a display surface such as a screen or have the light source positioned behind the LCD panel for direct viewing of an image produced on the LCD panel. A desire to reduce power consumption and improve the contrast of images displayed by LCD technology has led to various techniques for dynamically varying the light intensity of the light source and/or backlight of such LCD devices. Typically such variations in intensity of the light source results in a net dimming of the displayed image below the light intensity at which it was designed to be viewed.

In order to overcome this problem various compensation techniques have been proposed for an image being displayed. Techniques such as those described in U.S. patent publications 2006/0268180 and 2007/0092139 use tone-scale mapping to compensate the video signal for lower backlight intensity. These tone-mapping techniques utilise histogram analysis of the video image which requires high real-time computing power. Tone mapping is also suitable for whole backlight dimming, but is less suitable for dynamic and localised dimming techniques.

Another technique has been proposed in U.S. 2007/0041636 which utilises two sequential mapping functions. A first mapping value is determined by substituting RGB values into the first mapping function and a second enhanced mapping value is obtained by substituting the first mapping value into the second mapping function. Again such a technique has a high real-time computational overhead and while being suitable for whole backlight dimming is not a suitable for dynamic or localised dimming techniques.

SUMMARY OF THE INVENTION

Accordingly, is an object of the present invention to provide a backlight device for providing backlighting to a liquid crystal display panel and a method of controlling brightness of a liquid crystal display panel which overcomes or substantially ameliorates the above problems.

There is disclosed herein a method for image enhancement in a display illuminated by a lighting device. The method comprises providing a non-linear mapping function, determining an illumination level for the lighting device, determining by use of the mapping function and illumination level a compensation factor for each pixel, and adjusting brightness properties of each pixel by its compensation factor. There is also disclosed herein an apparatus having components for carrying out the method.

The mapping function relates a lighting device illumination level to a compensation factor. It may be a single dimensional lookup table having a plurality of predetermined compensation factors or an equation.

Preferably, the lighting device for the display has a plurality of illumination regions each have an illumination level and illuminating one or more pixels and the compensation factor of each pixel is determined based on the illumination level of the illumination region illuminating the pixel.

More preferably, the method and/or apparatus are practiced in an LCD panel illuminated by a dynamically illuminated backlight device having a plurality of independently controllable illumination regions.

Further aspects of the invention will become apparent from the following description.

BRIEF DESCRIPTION OF THE DRAWINGS

An exemplary form of the present invention will now be described by way of example only and with reference to the accompanying drawings, in which.

DESCRIPTION OF THE EXEMPLARY EMBODIMENTS

Figure 1:
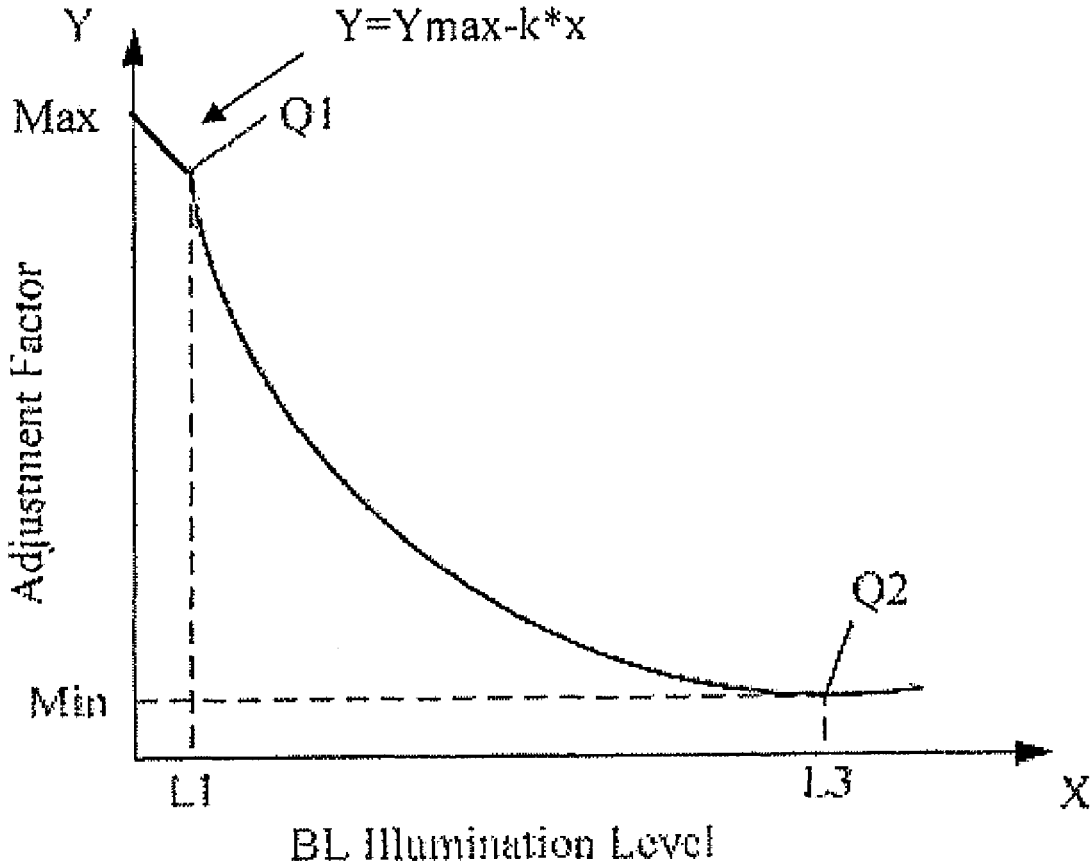
FIG. 1 is a graphical representation of a mapping function of the invention.

Reference will now be made in detail to an exemplary embodiment of the present invention, an example of which is illustrated in the accompanying drawings, wherein like reference numerals refer to like elements throughout.

The described exemplary embodiment illustrates the invention as practiced in a backlit LCD display, for example an LCD TV, used to show video images comprising a plurality of sequential frames each made up of a plurality of pixels. This is not intended to limit the scope of use or functionality of the invention. The invention is equally applicable to the enhancement of static images displayed on an LCD screen. For example, many organisations, advertisers or artisans use LCD screens to display static, albeit periodically changing, information, advertisements and/or photographs and images of artwork. The invention can equally be used to enhance the appearance on the screen of such information, advertisements and/or images.

Likewise, that the invention is exemplified as practiced in a backlit LCD display is not intended to limit the scope of use or functionality of the invention. The invention can equally be practiced in any display apparatus that uses a light source to project an image onto a projection surface or a flat panel display that uses a backlight to display images for direct viewing. Such displays include digital micro-mirror device displays (DMDs), liquid crystal on silicon (LCOs) displays and of course LCD displays.

In its earlier U.S. patent application Ser. No. 11/707,517, the entire contents of which are incorporated herein by reference, applicant describes an LCD display device having a backlight divided into a plurality of individually controllable illumination regions. Luminance of each illumination region is controlled in accordance with video signal properties for a corresponding region of the LCD display. If an area of the displayed image is bright then the corresponding illumination region of the backlight has high luminance and if a region of the image is dark then the corresponding illumination region of the backlight has no or low luminance. By dynamically controlling luminance of each illumination region of the backlight in accordance with properties of a corresponding part of the displayed image the contrast and dynamic range of the displayed image in improved. Additionally, each individually controllable illumination region of the backlight may comprise a variable colour lighting source, such as clusters of individually controllable red, green and blue (RGB) LEDs thus allowing the illumination region to be controlled from dark (black) through the colour spectrum to white. The backlight luminance and colour can be dynamically controlled in accordance with properties of the corresponding part of the displayed image in order to improve both colour contrast and colour dynamic range.

In U.S. patent application Ser. No. 11/707,517 the LEDs of the backlight are individually controlled and thus the brightness of the backlight is not uniform and varies with the image. Another benefit of this system is that the whole backlight brightness is generally dimmer than that of prior art constant backlight systems. This is because in the white or bright areas of the display image the backlight will be at its maximum value, which might typically be the same brightness as a prior art constant backlight systems, however significant portions of the image will have lower brightness and thus the backlight will be dimmer. In order to keep the viewable brightness of the image noticeably unchanged on the screen the LCD pixel transmittance is adjusted in accordance with backlight brightness levels. In this invention, after the backlight illumination level for each illumination region of the backlight is determined (the illumination of each backlight block/region varying with brightness of corresponding blocks of the image) an adjustment or compensation factor is determined for pixels illuminated by that block using a mapping function, and the transmittance of the relevant pixels adjusted by the adjustment or compensation factor.

The transmittance of a pixel in an LCD panel is controlled by the incoming RGB video signal according to the equation $$T=T_{max}\times(I/255)^{\gamma}$$

where T is LCD transmittance, I is the RGB digital code value corresponding to that pixel and γ is from the LCD panel gamma curve.

The apparent brightness of an image when viewed on the LCD display is a function of the backlight luminance and the LCD transmittance, which is given by the equation $$L=BL\times T$$

where L is the apparent brightness of an image, BL is the backlight luminance and, again, T is the LCD transmittance.

Substituting for T we get $$L=BL\times T_{max}\times(I/255)^{\gamma}$$

To keep the image brightness constant with any variance of the backlight illumination level we require that $$L'=L$$

$$BL'\times(I'/255)^{\gamma}=BL\times(I/255)^{\gamma}$$

$$I'=I\times[BL/BL']^{1/\gamma}$$

$$I'=[I^{\gamma}/\chi]^{1/\gamma}$$

where L' is the apparent brightness of the image after compensation, BL' is the new backlight luminance, I' is the RGB digital code value after compensation and χ is a adjustment factor related to the change in backlight luminance.

The relationship between adjustment factor χ and backlight illumination level is graphically illustrated in FIG. 1 wherein the X-axis represents backlight illumination level BL' and the Y-axis represents the pixel transmittance adjustment factor χ. The curve of FIG. 1 can be defined by a mapping function of the form:

$$Y=\begin{cases} Y\min & L3<x\le L\max \\ 1/(x+a) & L1<x\le L3 \\ Y\max-K\times x & 0\le x\le L1 \end{cases}$$

When the overall backlight illumination level is high (>L3) the adjustment factor is at a minimum and when the backlight illumination level is low (<L1) the adjustment factor is linearly decreased from maximum to a certain value. While the backlight illumination level is moderate, the adjustment factor is inversely proportional to the illumination level with an offset constant, a. The value of constant a is determined based on the LCD display properties.

This mapping function may be stored in the brightness controller as a function for determination of the adjustment factor by calculation. However, in the preferred embodiment the mapping function is stored as a single dimension look-up table (LUT) in which a corresponding adjustment factor for the full range of backlight illumination levels from 0 to Lmax are given. After determination of the appropriate adjustment factor each pixel in the image is adjusted by the adjustment factor.

Figure 2:
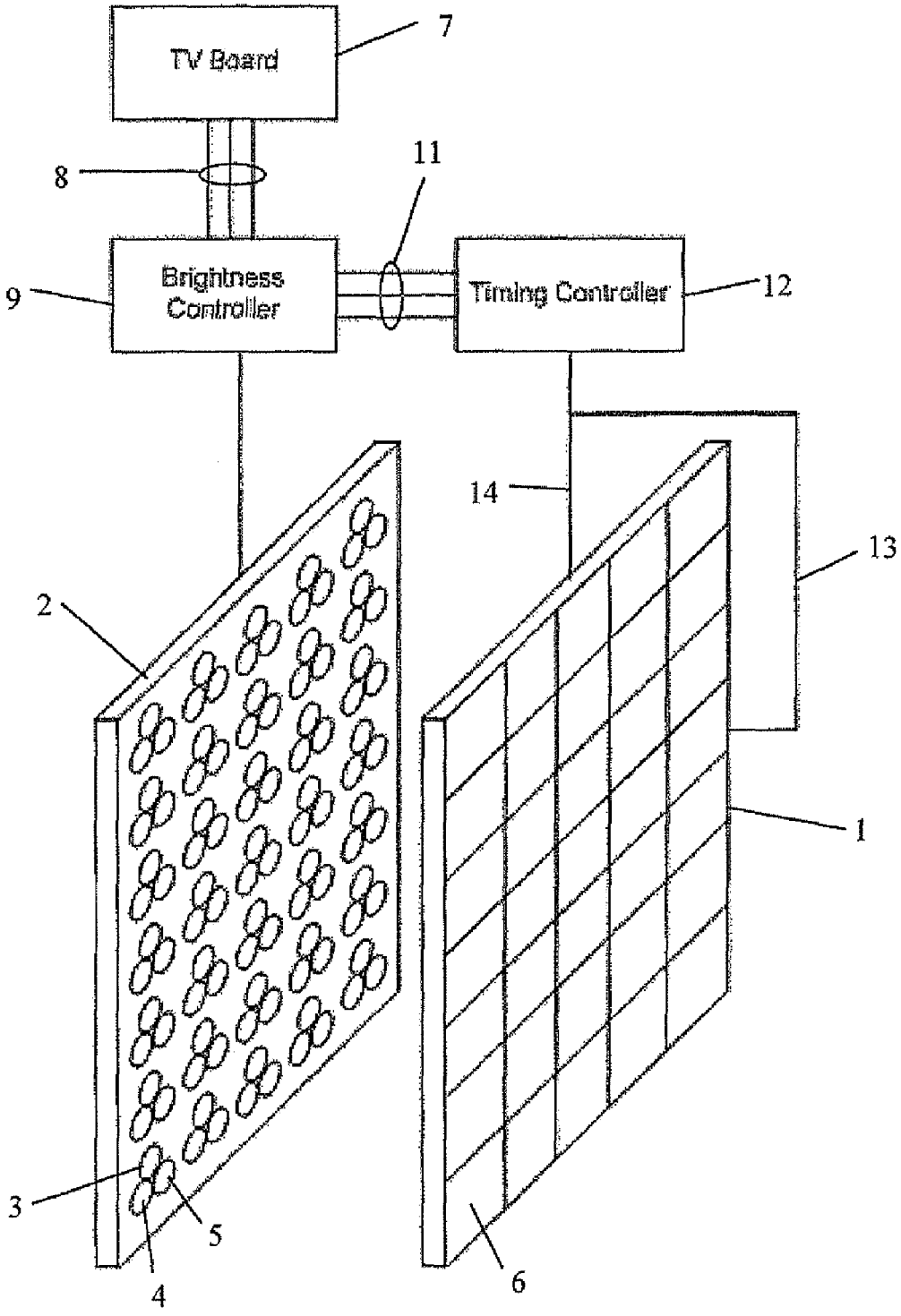
FIG. 2 is a schematic overview of an LCD TV employing a method and apparatus of the invention.

Referring to FIG. 2 there is shown a schematic overview of a backlit LCD display, in this instance a LCD TV, of the type described in U.S. patent application Ser. No. 11/707,517. The display comprises an LCD panel 1 located in front of a backlight 2. The backlight 2 is divided into a plurality of individually controllable illumination regions. In the illustrated embodiment there are only 5×7 regions shown for clarity. In the preferred embodiment of the invention each region comprises a cluster of red 3, green 4 and blue 5 LEDs so that the region light output can be from black to white through the colour spectrum. This is not essential to the invention and in other embodiments the backlight regions comprises just white LEDs or other light sources. The LCD panel is notionally, but not physically, divided into an equal number of display regions 6. The TV board 7 receives image signals from various video sources such as PC, DVD player, Cable TV and so on, through analog or digital interfaces as is known. After processing the incoming signals, the TV board generates video signals 8 in RGB format and passes the video signal 8 to a brightness controller 9. The brightness controller 9 analyses the incoming video signal 8 and provides driving signals 10 to LED drivers of the individual illumination regions of the backlight 2. This function of the brightness controller 9 is in accordance with that described in U.S. patent application Ser. No. 11/707,517. The brightness controller 9 then enhances the video signal, and in particular compensates brightness information of the signal so that brightness of the overall displayed image is not affected by the overall brightness, or dimness, of the backlight 2. A compensated video signal 11 from the brightness controller 9 goes to the timing controller 12 which issues vertical 13 and horizontal 14 signals to corresponding liquid crystal drivers.

Figure 3:
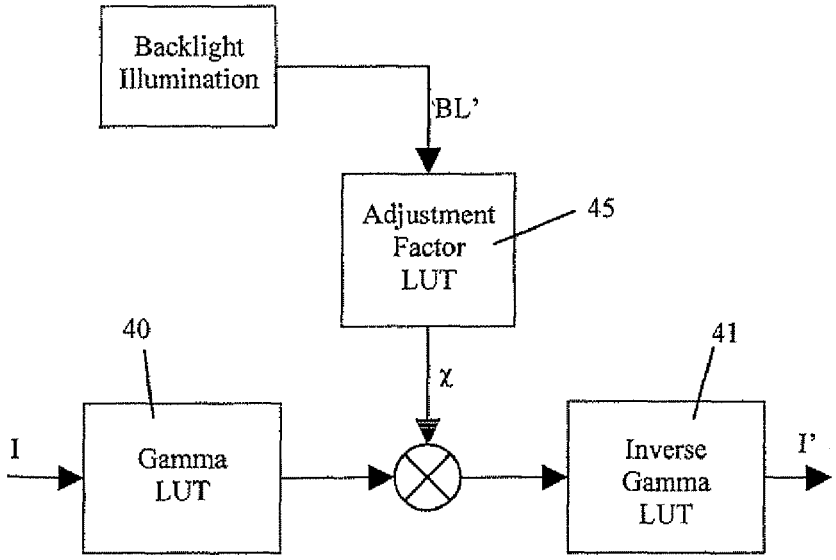
FIG. 3 is a schematic illustration of image enhancement.

FIG. 3 is a signal flow diagram of LCD compensation. The code value I of the video signal is converted to a gamma value using a gamma look up table (LUT) 40. An adjustment factor χ is determined using an adjustment factor look up table 45 and the backlight illumination level BL'. The gamma value is adjusted by the adjustment factor at a multiplying junction and then the compensated gamma value is converted back into a video signal code value via an inverse gamma look up table 41. In the current embodiment of the invention, which comprises a color backlight with red, blue and green LEDs, the illumination level of the individual red, green and blue LEDs of the backlight will vary depending on the determined color and light intensity of the backlight. In order to maintain the best image quality each color channel of the video signal for the LCD display should be compensated separately in accordance with the respective illumination level of the red, green or blue component in the backlight.

In an alternative embodiment of the invention the backlight is a simple white color although it is divided into different backlight illumination regions so that different areas can be illuminated at different brightness levels. In this embodiment of this invention there is only one brightness level for each region of the backlight and so each color channel of the RGB video signal for the LCD display is adjusted by the same adjustment factor.

Figure 4:
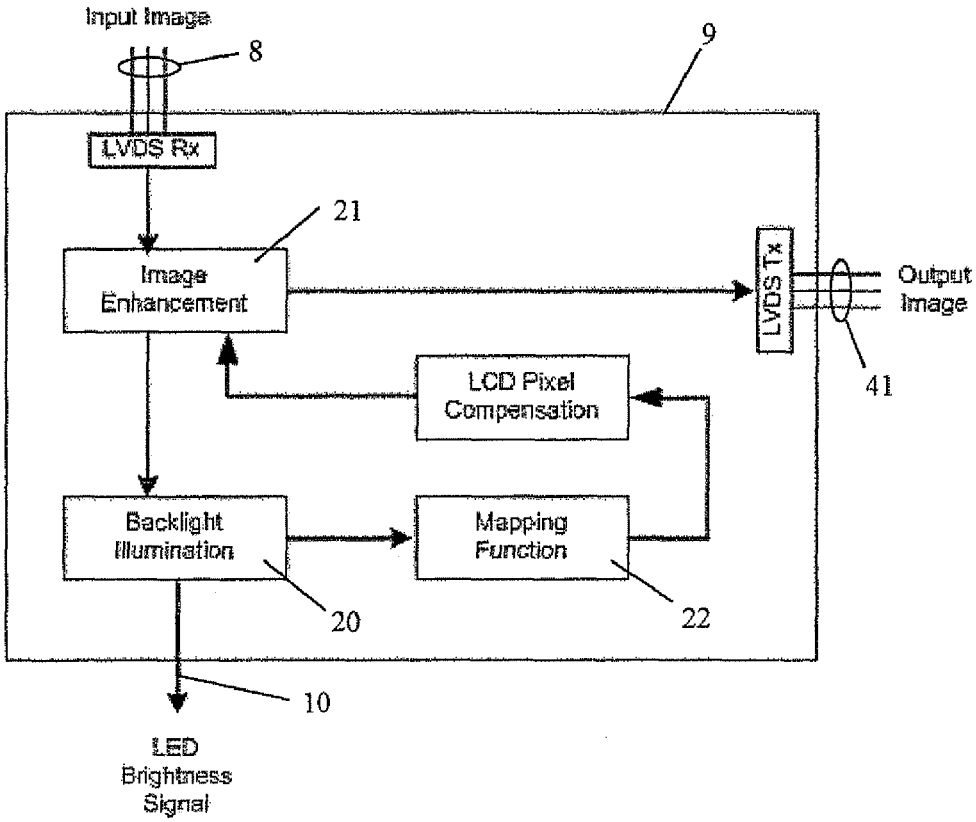
FIG. 4 is a schematic block diagram of a brightness and image enhancement controller of FIG. 1.

FIG. 4 shows the individual block components of the brightness controller 9. The brightness controller performs image enhancement, backlight illumination simulation and LCD pixel compensation functions. The backlight illumination simulation component 20 operates in accordance with the details provided in U.S. patent application Ser. No. 11/707,517. Image enhancement and image signal compensation are performed in components 21 and 22.

An example and exemplified embodiment of the invention have been described above. This is not intended to limit the scope of use of functionality of the invention. It should be appreciated that modifications and alternations obvious to those skilled in the art are not to be considered as beyond the scope of the present invention.

What is claimed is:

1. A method for controlling a display controller to enhance an image displayed on a display that is controlled by the display controller and illuminated by a lighting device, the image comprising a plurality of pixels, each pixel having an individually adjustable property, the display comprising a transmittance level for each pixel of the image, the method comprising:

storing a mapping function in a non-transitory machine readable storage medium of the display controller, wherein the mapping function includes a linearly decreasing mapping portion, a non-linear mapping portion, and a constant portion;

determining an illumination level of the lighting device for each pixel;

determining, by use of the mapping function and the illumination level, a respective compensation factor for each pixel, including using the linearly decreasing mapping portion to determine the compensation factor when the illumination level is below a first threshold, using the non-linear mapping portion to determine the compensation factor when the illumination level is above the first threshold and below a second threshold; and using the constant portion to determine the compensation factor when the illumination level is above the second threshold;

adjusting the property of each pixel by the compensation factor of the respective pixel; and adjusting the transmittance level of the display for each pixel by the adjusted property of the respective pixel.

2. The method of claim 1 wherein the mapping function relates lighting device illumination levels to compensation factors.

3. The method of claim 1 wherein each compensation factor decreases or remains constant with increasing illumination level.

4. The method of claim 1 including storing the mapping function as a single dimensional look-up table relating lighting device illumination levels to compensation factors.

5. The method of claim 1 including expressing the linearly decreasing mapping portion as an equation of the form $$y = \frac{1}{(x + a)},$$

where y is the compensation factor, x is the illumination level of the lighting device, and a is a constant.

6. The method of claim 5 including determining a based on display characteristics.

7. The method of claim 1 wherein the lighting device comprises a plurality of illumination regions, each illumination region having an illumination level and illuminating one or more pixels, and determining the compensation factor of each pixel based on the illumination level of the illumination region illuminating the pixel.

8. The method of claim 7 wherein the mapping function maps illumination levels to corresponding compensation factors.

9. The method of claim 1 when practiced in a liquid crystal display (LCD) panel illuminated by a dynamically illuminated backlight device having a plurality of independently controllable illumination regions.

10. The method of claim 1 wherein the image is a video image in which the plurality of pixels comprise a plurality of sequential video image frames.

* * * * *